United States Patent [19]

Pochan et al.

[11] 4,063,947

[45] Dec. 20, 1977

[54] PHOTOCONDUCTIVE INSULATING FILMS COMPRISING FLUORENONE-SUBSTITUTED OLIGOMERS

[75] Inventors: John M. Pochan, Rochester; Sam R. Turner, Webster, both of N.Y.

[73] Assignee: Xerox Corporation, Stamford, Conn.

[21] Appl. No.: 626,957

[22] Filed: Oct. 29, 1975

[51] Int. Cl.[2] ..... G03G 5/04

[52] U.S. Cl. ..... 96/1.5 N; 96/1.6; 252/501

[58] Field of Search ..... 96/1.5, 1.6; 252/501

[56] References Cited

U.S. PATENT DOCUMENTS

| | | | |
|---|---|---|---|
| 3,307,940 | 3/1967 | Hoegl et al. | 96/1.5 |
| 3,752,668 | 8/1973 | Baltazzi | 96/1.5 |
| 3,864,126 | 2/1975 | Nishide et al. | 96/1.5 |
| 3,867,140 | 2/1975 | Hashimoto | 96/1.5 |
| 3,871,883 | 3/1975 | Hashimoto | 96/1.5 |

FOREIGN PATENT DOCUMENTS

| | | | |
|---|---|---|---|
| 1,337,227 | 11/1973 | United Kingdom | 96/1.5 |

*Primary Examiner*—Edward C. Kimlin
*Attorney, Agent, or Firm*—James J. Ralabate; James P. O'Sullivan; John H. Faro

[57] ABSTRACT

Composite photoconductive insulating films comprising a thin layer of photoconductive materials having substantial spectral response in the visible region of the electromagnetic spectrum and a substantially colorless insulating layer contiguous therewith comprising a minor portion of electronically inert binder in a major portion of an electronically active oligomer of the formula:

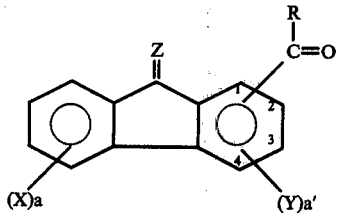

wherein R is

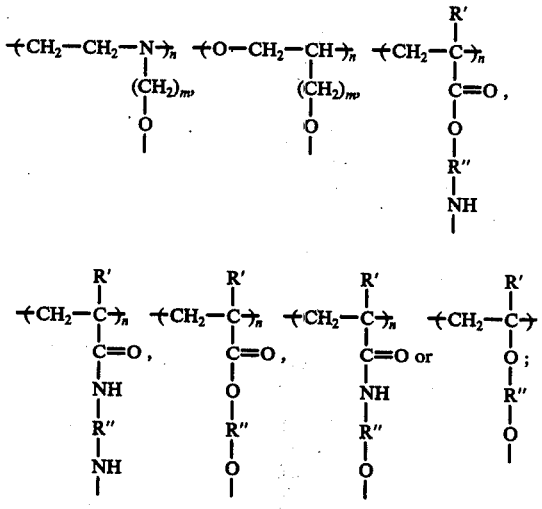

R' is hydrogen or methyl;
R'' is alkyl of 1–10 carbon atoms;
X and Y are independently selected from the group consisting of $NO_2$, halogen, cyano and $—CF_3$;
Z is oxygen or dicyanomethylene;
*a* and *a'* can range from 0–3;
*m* is 1–10; and
*n* is in the range of from about 3 to about 25.

6 Claims, No Drawings

PHOTOCONDUCTIVE INSULATING FILMS COMPRISING FLUORENONE-SUBSTITUTED OLIGOMERS

BACKGROUND OF THE INVENTION

1. Field of the Invention

This invention relates to photoconductive insulating films, articles containing such films and imaging methods employing these articles. More specifically, this invention is directed toward a composite photoconductive insulating film wherein one layer of said film comprises a major portion of electronically active oligomers and a minor portion of electronically inert polymers.

2. Description of the Prior Art

In the electrophotographic arts the photoresponsive component of the imaging member has been traditionally constructed so that one layer of photoconductive material has been primarily responsible for the absorption of imaging energies, the generation of charge carriers in response thereto and the transport of such charge carriers throughout the bulk of the layer. The electronic properties of the materials used in such a layer should be capable of rapid switching from insulating to conductive to insulating state in order to permit cyclic use of the imaging surface of said layer. The failure of a material to return to its relatively insulating state prior to the succeeding charging sequence will result in a decrease in the maximum charge acceptance of the photoconductor. This phenomenon, commonly referred to in the art as "fatigue", has in the past been avoided by the selection of photoconductive materials possessing rapid switching capacity. Typical of the materials suitable for use in such a rapidly cycling imaging system include anthracene, sulfur, selenium and mixtures thereof (U.S. Pat. No. 2,297,691); selenium being preferred because of its superior photosensitivity.

In addition to anthracene, other organic photoconductive materials, most notably poly(N-vinylcarbazole), have been the focus of increasing interest in electrophotography. Most organic photoconductive materials, including poly(N-vinylcarbazole), lack the inherent photosensitivity to be competitive with selenium. This need for enhancement of the photoresponse characteristics of organic photoconductors thus lead to the formulation of these organic materials with other compounds, commonly referred to as "activators". Poly(vinylcarbazoles), for example, when sensitized with 2,4,7-trinitro-9-fluorenone exhibit good photoresponse and discharge characteristics and (depending upon the polarity of the surface charge), low dark decay, U.S. Pat. No. 3,484,237. Ordinarily, the bulk absorption of activating electromagnetic radiation and the consequent generation of charge carriers can and often does result in some trapping of at least one species of charge carrier within the photoconductive layer and thus some impairment in the cycling characteristics of the imaging member. This disadvantage is also present where the absorption of imaging energies and the generation of charge carriers is performed by one component of a binder layer (hereinafter functionally designated as the "charge carrier generating material") and the transport of charge carriers through the bulk of said layer by a second chemically distinct component (hereinafter referred to as "electronically active matrix material"), U.S. Pat. No. 3,121,007 and U.K. Pat. No. 1,343,671.

In order to avoid the cycling limitations generally inherent in such single layered systems, it has been proposed that the functions of (a) charge carrier generation (resulting from photoactivation) and (b) charge carrier transport can be performed more satisfactorily - (with respect to cycling) — where each of these two separate functions is performed by separate but contiguous layers (U.K. Pat. No. 1,337,228 and Can. Pat. No. 932,199). In these multi-layered configurations, absorption of imaging energies and generation of charge carriers is exclusively limited to the layer of photogenerator materials. Substantial absorption and photogeneration of charge carriers within the bulk of the charge carrier transport layer can reportedly impair the cycling characteristics of this type of composite and thus is to be avoided. In U.K. Pat. No. '228 the transport layer is capable of facile transport of either holes or electrons which are injected into it from the layer of light-absorbing charge carrier generating materials contiguous therewith. In Can. Pat. No. '199 the charge carrier transport layer is capable of facile transport of electrons injected into it from a contiguous layer of light-absorbing charge carrier generating material. Neither patent specifically discloses a polymer having an electron acceptor moiety capable of satisfactory performance in such a transport layer. The Canadian patent does, however, indicate that such polymers can be expected to perform in a manner equivalent to binder layers containing nonpolymeric electron acceptor materials.

Monomers having relatively weak electron acceptor groups pendant therefrom are disclosed in U.S. Pat. No. 3,418,116 and U.S. Pat. No. 3,697,264. In each instance these monomers are copolymerized with a second monomer having pendant therefrom a relatively strong electron donor group. The resulting polymers reportedly are photoconductive due to the charge transfer interbetween adjacent pendant groups having differing electron affinities.

Attempts to prepare monomers having relatively strong electron acceptor groups (groups having an electron affinity in excess of about 0.7 electron volts) have been generally unsuccessful. This fact is borne out by the relatively few disclosures of strong electron acceptor functional monomers reported in the technical literature.

Ordinarily, the preparation of copolymers having strong electron acceptor groups appended from their backbone is beset with a number of difficulties. Due to the strong electron affinity of such pendant groups, it is virtually impossible to initiate polymerization of such monomers by free-radical techniques, since the electron acceptor moiety quenches the free radical prior to substantial polymerization of the monomer. This problem has led to attempts at introducing electron withdrawing substituents on groups pendant from a preformed polymer which does not already inherently possess strong electron acceptor properties. This approach also encounters serious synthesis hurdles since attempts at, for example, nitration of poly(vinylfluorenone) results in degradation of the polymer and reduction in its solubility in common solvents (presumably due to crosslinking), Gibstein et al, Polymer Letters, Volume 9, page 671 (1971).

In both U.K. Pat. No. '228 and Can. Pat. No. '199 discussed previously, it was indicated the electron acceptor systems can be prepared by dispersing and/or dissolving a nonpolymeric electron acceptor in a suitable binder and casting or coating this composition as a film on a layer of charge carrier generating materials. In terms of long term cycling stability, such binder system transport layers are not equivalent to transport layers prepared from polymers. Such binder layers can at best be described as metastable, undergoing a progressive decline in their electronic properties. Such instability is believed to be due in part to the tendency of such nonpolymeric materials to migrate within the polymeric binder and thereby cause phase separation due to crystallization. Thus, such binder layer transport layers would be precluded from use in a composite photoconductive layer requiring repeated cycling of this imaging member over an extended period of time, since the electronic properties of the imaging member would not be capable of remaining within the machine specifications for such a device. The electron transport layer configuration of the multi-layered photoconductor referred to in U.K. Pat. No. '228 and Can. Pat. No. '199 is superior to the hole transport layer system in that the electron transport system is relatively insensitive to oxidative degradation and unlike the hole transport analog, is capable of maintaining more stable electronic performance, thus, prolonging its useful lifetime within an electrophotographic reproduction system.

Accordingly, it is the object of this invention to remedy the above as well as the related deficiencies in the prior art.

More specifically, it is the primary object of this invention to provide a composite photoconductive insulating film wherein one layer of said film is capable of rapid and efficient transport of electrons and yet incapable of substantial spectral response in the visible region of the electromagnetic spectrum.

It is another object of this invention to provide a composite photoconductive insulating film wherein the transport layer of said film is capable of stable electronic performance.

It is yet another object of this invention to provide a composite photoconductive insulating film wherein the transport layer of said film possesses the advantages of both polymers and nonpolymeric materials and yet is free from the disadvantages of both.

Additional objects of this invention include the use of the above composite photoconductive insulating films in electrophotograhic imaging members and methods.

SUMMARY OF THE INVENTION

The above and related objects of this invention are achieved by providing composite photoconductive insulating films comprising a layer of photoconductive materials having substantial spectral response in the visible region of the electromagnetic spectrum and a substantially colorles insulating layer contiguous therewith comprising a polymeric solid containing a minor portion of electronically inert polymeric binder and a major portion of electronically active oligomer of the formula:

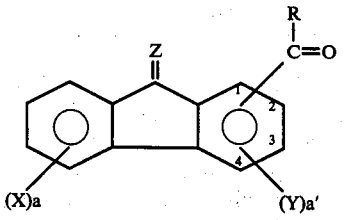

wherein R is

-continued

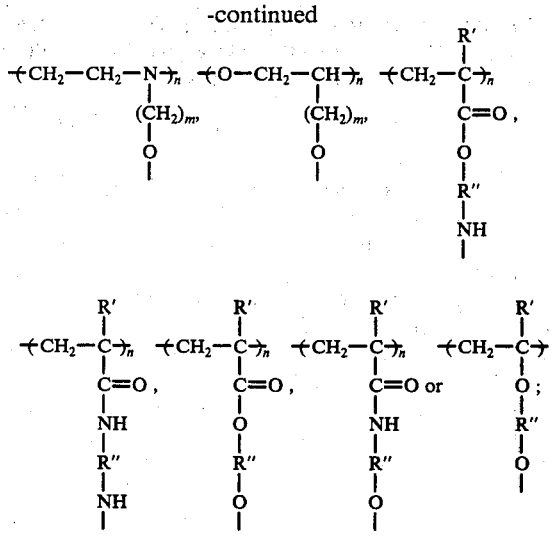

R' is hydrogen or methyl;

R'' is alkyl of 1–10 carbon atoms;

X and Y are independently selected from the group consisting of $NO_2$, halogen, cyano and $—CF_3$;

Z is oxygen or dicyanomethylene;

*a* and *a'* can range from 0–3;

*m* is 1–10; and

*n* is in the range of from about 3 to about 25.

The thickness of the photoconductive layer in this composite film can range from about 0.02 to about 5 microns and the thickness of the insulating layer from about 1 to about 200 microns; the ratio of thickness of the photoconductive layer to insulating layer being maintained within from about 1:2 to about 1:200.

DESCRIPTION OF THE INVENTION INCLUDING PREFERRED EMBODIMENTS

The monomers suitable for use in preparation of the oligomers of the insulating layer of the photoconductive deposit can be prepared by esterfication of an acid chloride derivative of fluorenone or an acid chloride derivative of a substituted fluorenone with a hydroxyl or amino functional monomer reactant in the presence of an appropriate amine. The monomeric product of this esterification reaction can then be polymerized by techniques traditionally employed in epoxy-type or acrylate addition polymerization reactions.

The fluorenone reactant used in preparation of the above monomers can be initially prepared by at least three different techniques (depending upon the position of attachment of the carboxylic acid substituent on the fluorenone ring). For example, fluorenone-1-carboxylic acid can be prepared by reaction of fluoranthrene with chromic acid in an acetic acid medium, J. Am. Chem. Soc. 57, 2174 (1935). Fluorenone-2-carboxylic acid can be prepared by reaction of fluorene with acetic acid anhydride in the presence of a Lewis acid followed by exposure of the resulting product to a strong oxidizing agent in order to convert it to the corresponding fluorenone, J. Org. Chem. 35, 2762 (1970). Fluorenone-4-carboxylic acid can be prepared by reaction of diphenic acid with sulfuric acid under the appropriate conditions, Fieser and Fieser "Advanced Organic Chemistry", Rheinhold Publishing Company, page 807 (1961). Each of the above carboxylic acid derivatives of fluorenone can be subsequently converted to the corresponding nitro analog by standard nitration techniques. These carboxylic acid derivatives of fluorenone and carboxylic acid derivatives of nitro fluorenones can thereafter be readily converted to the corresponding acid chloride by reaction with thionyl chloride, phosphorous chloride or phosphorous pentichloride.

The alcohol or amino functional monomer reactants suitable for use in preparation of the monomers referred to hereinabove are embraced by the following formulae:

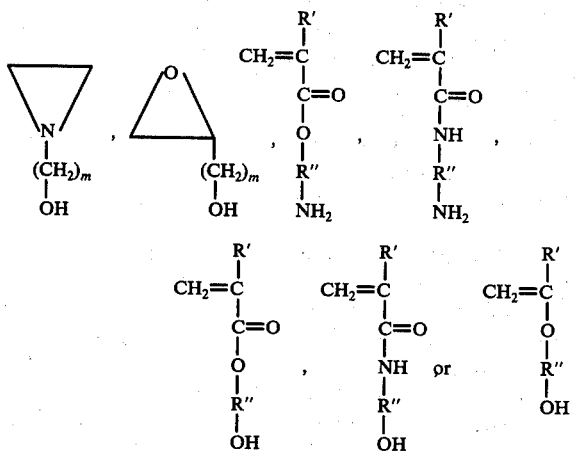

R′ is hydrogen or methyl;
R″ is alkyl of 1–10 carbon atoms;
X and Y are independently selected from the group consisting of $NO_2$, halogen, cyano and $—CF_3$;
Z is oxygen or dicyanomethylene;
*a* and *a′* can range from 0–3; and
m is 1–10.

These monomer reactants can be prepared by techniques and with equipment disclosed in the literature and in certain instances, are commercially available from Polysciences Inc. of Warrington, Pa. Representative of the alcohol and amino functional monomer reactants which can esterfied with the acid chloride derivatives of fluorenone and the acid chloride derivatives of substituted fluorenones include glycidol, 2-hydroxyethyl-methacrylate, 4-hydroxybutyl-methacrylate, 2-aminoethyl-methacrylate, 2-aminoethyl-methacrylamide, 2-hydroxyethyl-methacrylate, 2-hydroxyethyl-methacrylamide, vinyl-4-hydroxybutyl ether and N(2-hydroxyethyl) azirdine.

In a typical synthesis of the monomeric precursor of the oligomers which can be formed into the transport layer of a photoconductive insulating composite, an acid chloride derivative of fluorenone or an acid chloride derivative of a substituted fluorenone and an alcohol or amino functional monomer reactant are contacted with one another in the presence of a tertiary amine in a suitable solvent. The reaction mass containing these materials is then allowed to react under ambient conditions or can be gently heated to facilitate the esterfication of the acid chloride and the alcohol. Acid which is liberated upon the esterfication of these materials is absorbed by the amine. Amines which are suitable for use in absorption of the acid by-products of the esterfication reaction include any of the tertiary amines; especially the alkyl substituted tertiary amines. The solvent which can provide the reaction medium for this esterfication reaction includes any aprotic solvent within which the above reactants are soluble. After the esterfication reaction has proceeded for the period desired, the ester thus produced is separated from the reaction mass by initial evaporation of the reaction medium followed by extraction of the by-products of the esterfication reaction and unreacted materials with the appropriate solvents.

Once having isolated the sought after monomeric esterfication product (ester), it can be polymerized to oligomers by conventional techniques which are disclosed in the literature for polymerization of epoxy and addition-type monomers. The ring opening polymerization reaction of the epoxy monomer does not, however, proceed very efficiently; presumably due to the behavior of the monomer as a chain transfer agent thus severely restricting the length of the growing polymer chains. The degree of polymerization of the other monomers can be controlled through the use of chain transfer agents or by controlling the relative concentration of monomers and/or initiator compounds and/or the polymerization conditions see, for example, *Experiments in Polymer Sciences,* Collins, Bares and Billmeyer, Interscience Publishers Inc., New York City and *Preparative Methods of Polymer Chemistry,* Sorensen and Campbell, Interscience Publishers Inc., New York City. In the preferred embodiments of this invention, the degree of polymerization of the oligomer is in the range of about 3 to about 25 and most preferably from about 8 to about 15. The film-forming capabilities of these oligomers are generally unsatisfactory in that solvent coated films of these materials do not form cohesive layers.

The oligomers (prepared by the techniques described hereinabove) can, however, be used in combination with other film-forming polymeric binders in the formation of electronically active coatings having good mechanical and physical integrity. In a preferred embodiment of this invention, the relative weight ratio of oligomers to polymeric binder can range from about 50:50 to about 95:5; the optimum concentration of oligomer to polymeric binder being, of course, determined to a great extent by the degree of polymerization of the oligomer. The use of polymeric binders in combination with these electronically active oligomers, thus, enables the tailoring of the mechanical properties of the resulting film through the judicious selection of the polymeric binder. The oligomers, especially the lower molecular weight oligomers, can also act to plasticize such polymeric binders and thus increase the flexibility of the resulting coating and further enhance its other mechanical properties. The polymeric composition thus prepared will be inherently less prone to crystallization of the electronically active materials than analogous systems (e.g. molecular dispersions of 2,4,7-trinitro-9-fluorenone in polyester resins); and in addition, its mechanical properties will also be superior to films prepared from higher molecular weight electronically active polymers above.

The polymeric binders, which are suitable for use in combination with the above oligomers in preparation of the insulating layers of the composite photoconductive films of this invention, are generally regarded as electronically "inert" and are independently capable of forming mechanical, stable self-supporting films. Representative of such binders are the polyolefins, polyesters, the polycarbonates, cellulose esters, polysiloxanes, polyurethanes, copolymers, blends and mixtures thereof. The electronic inertness of such binder is intended as descriptive of the inability of such binders to effectively generate charge carriers upon irradiation with electromagnetic radiation within the wavelengths commonly employed in electrophotography and the inability of such binders to effectively transport charge carriers at reasonable field intensities which are injected into their bulk.

In the preferred embodiments of this invention, the oligomers and the polymeric binders are phase compatible and when combined, form transparent, substantially colorless glassy films. These films can be typically prepared by dissolving the oligomer and the polymeric binder in a common solvent and casting or coating the resulting solution on an appropriate substrate.

In preparation of the composite photoconductive insulating films of this invention, an insulating layer can be initially prepared from the oligomer and polymeric binder and a layer of photoconductive materials subsequently deposited thereupon.

The photoconductive materials of this second layer are preferably photoresponsive in the visible region of the electromagnetic spectrum and must be sufficiently electronically compatible with the insulating layer containing the electronically active oligomer to enable the injection of charge carriers from the layer of photoconductive materials into the layer containing the electronically active oligomer. Photoconductive materials which satisfy the above requirements are disclosed in Canadian Pat. No. 932,199 (which is hereby incorporated by reference); the especially preferred photoconductive materials being the phthalocyanine pigments, trigonal selenium and amorphous selenium. These composite photoconductive insulating films can thereafter be associated (either permanently or temporarily during imaging) with a conductive substrate and thus employed in electrophotography. In a typical embodiment of this invention a conductive film is formed on either the free surface of the photoconductive layer or the free surface of the electronically active insulating film by vacuum deposition techniques. Alternatively, a preformed conductive foil can be bonded to either of the free surfaces referred to above with a suitable adhesive (e.g. Mylar 49000, available from E. I. du Pont de Nemours and Co.).

The Examples which follow further define, describe and illustrate the preparation and use of oligomeric compositions in electrophotographic imaging members and methods. Techniques and apparatus used in the preparation and evaluation of these compositions and imaging member prepared from these compositions are standard or as hereinbefore described. Parts and percentages appearing in such Examples are by weight unless otherwise stipulated.

EXAMPLE I

Preparation of glycidyl-4,5,7-trinitro-9-fluorenone-2-carboxylate

Fluorene is initially reacted with acetic anhydride in the presence of aluminum chloride thereby forming 2-acetyl fluorene, J. Org. Chem. 35: 8 2765 (1970). 2-Acetyl fluorene is thereafter oxidized to fluorenone-2-carboxylic acid in the following manner (as per Organic Synthesis, Coll. Vol. III, p 240). A 5 liter 3-necked round bottom flask, equipped with a magnetic stirring bar, reflux condenser and addition funnel is charged with 50 grams of 2-acetyl fluorene and 650 milliliters of glacial acetic acid. This solution is warmed sufficiently until the 2-acetyl fluorene is dissolved in the glacial acetic acid. A total of about 450 grams sodium dichromate dihydrate is slowly added to the solution over a period of about 60 minutes. After such addition is complete, the mixture is heated to boiling under reflux and 200 milliliters of acetic anhydride introduced into the reaction vessel through the addition funnel over a period of about 90 minutes. Heating under reflux conditions is continued overnight. The following morning, the hot solution is poured into 9 liters of hot water, stirred for 50 minutes and then filtered through a Buckner funnel. The filter cake is washed with four 400 milliliter portions of 2 percent sulfuric acid. The yellow product remaining in the funnel is thereafter transferred to a 4 liter beaker containing 700 milliliters of 5 percent potassium hydroxide. This mixture is stirred and heated for about 20 minutes on a steam bath. When the temperature of the mixture reaches 70° C, it is filtered. The insoluble material is subsequently treated with several 50 milliliter portions of hot 5 percent potassium hydroxide. The filtrates are collected and combined, treated with a few grams of activated charcoal and filtered. The filtered solution is then heated to a temperature in the range of from between 65° to 70° C with vigorous agitation and 200 milliliters of 18 percent hydrochloric acid added by dropwise addition. A thick yellow voluminous precipitate is formed which is heated for an additional 15 minutes at 85° C. After filtration, the product is again washed with five 200 milliliter portions of hot water and air dried overnight. Further drying is accomplished by vacuum treatment at 100° C for 16 hours. Yield 25.1 grams bright yellow crystals of fluorenone-2-carboxylic acid.

The fluorenone-2-carboxylic acid is thereafter nitrated in the conventional manner with a mixture of fuming nitric acid and concentrated sulfuric acid. The nitrated product is recovered and purified in the conventional manner. Analysis of this product indicates it to be 4,5,7-trinitro-9-fluorenone-2-carboxylic acid. This product is subsequently contacted with thionyl chloride thereby producing 4,5,7-trinitro-9-fluorenone-2-carboxylic acid chloride.

Into a 250 mililiter Erlenmyer flask are placed 10.03 grams (0.026 moles) of 4.5.7-trinitro-9-fluorenone-2-carboxylic acid chloride and 100 milliliters of tetrahydrofuran. This mixture is stirred by means of a magnetic stirring bar until the above materials are completely dissolved in the solvent. About 2.60 grams (0.026 moles) of triethylamine are dissolved in 20 milliliters of tetrahydrofuran and slowly added to the contents of the flask. Upon completion of this addition, some cloudiness of the solution is noted. To the solution is subsequently added 2.1 grams (0.029 moles) of glycidol dissolved in 200 milliliters of tetrahydrofuran. The addition of the glycidol solution to the Erlenmeyer flask is accomplished by dropwise addition. Subsequent to such addition, some precipitate is observed in the flask. The materials in the flask are allowed to react for 90 minutes. This previously noted precipitate, subsequently identified as triethylamine hydrochloride, is removed from the flask by filtration and the solution which is recovered carefully evaporated to dryness at 35° C on a rotary evaporator. The solids which remain are taken up in methylene chloride and extracted with water for removal of residual traces of triethylamine hydrochloride. The hydrated product is extracted with several portions of methylene chloride. The methylene chloride solution of the monomer is dried over magnesium sulfate, filtered and evaporated to dryness on a rotary evaporator. The foam-like solid which forms is taken up in 10 millimeters methylene chloride per gram of solid and precipitated by stirring into hexane. A very light yellow powdery material is obtained which is subsequently identified by standard chemical analysis as glycidyl-4,5,7-trinitro-9-fluorenone-carboxylate. The synthesis yield is approximately 70 percent.

EXAMPLE II

Preparation of 2-ethylmethacryl-4,5,7-trinitro-9-fluorenone-2-carboxylate

This material is prepared according to the procedures described in Example I merely by substitution of 2-hydroxyethyl methacrylate for glycidol.

EXAMPLE III

Preparation of 2-ethylmethacrylamide-4,5,7-trinitro-9-fluorenone-2-carboxylate

This material is prepared according to the procedures described in Example I merely by substitution of 2-hydroxyethyl methacrylamide for glycidol.

EXAMPLE IV

Preparation of 2-aminoethylmethacryl-4,5,7-trinitro-9-fluorenone-2-carboxylate

This material is prepared according to the procedures described in Example I merely by substitution of 2-aminoethyl methacrylate for glycidol.

EXAMPLE V

Preparation of 2-aminoethylmethacrylamide-4,5,7-trinitro-9-fluorenone-2-carboxylate This material is prepared according to the procedures described in Example I merely by substitution of 2-aminoethylmethacrylamide for glycidol.

EXAMPLE VI

Preparation of N-(2-butyl) azirdine-4,5,7-trinitro-9-fluorenone-2-carboxylate

This material is prepared according to the procedures described in Example I merely by substitution of N(2-hydroxybutyl) azirdine for glycidol.

EXAMPLE VII

Preparation of vinyl-(4-butyl) ether-4,5,7-trinitro-9-fluorenone-2-carboxylate

This material is prepared according to the procedures described in Example I merely by substitution of vinyl-4-hydroxybutyl ether for glycidol.

EXAMPLE VIII

Polymerization of glycidyl-4,5-trinitro-9-fluorenone-2-carboxylate

A 100 milliliter three-necked round bottom flask equipped with a magnetic stirrer is charged with 1.0 grams glycidol-4,5,7-trinitro-9-fluorenone-2-carboxylate and 20 milliliters methylene chloride (which has been previously purified by passage through an alumina column). Upon intermixing of these two materials a deep brownish-red solution is formed. The initiator for this polymerization is prepared by diluting 1 milliliter boron trifuoride etherate to 10 milliliters with methylene dichloride. Both the reaction vessel and its contents and the initiator are now chilled to 0° C. The reaction vessel is purged of air with nitrogen and 1 weight pecent (0.1 milliliter) of the initiator introduced into the reaction vessel via a syringe which has been inserted through a rubber septom of the reaction vessel. Immediately after introduction of the initiator, the contents of the flask become cloudy followed by a general lightening in color of the solution. During the course of the next two hours, a precipitate is formed in the flask. The contents of the flask is thereafter emptied into a beaker containing 100 milliliters of methanol, and the precipitate (which is formed) is separated from the methanol by filtration. This precipitate is purified by reprecipitation from THF with methanol. Yield 0.17 grams polymer, $M\overline{n}$ = 2,200 (as determined by standard vapor pressure osmometry techniques).

EXAMPLE IX

Polymerization of 2'-ethylmethacryl-4,5,7-trinitro-9-fluorenone-2-carboxylate

Into a polymer tube is added 2.5 grams of the monomer obtained from Example II, 8 millimeters acetone (which has been previously dried over a 3 Angstrom unit molecular sieve) and 0.025 grams azobisisobutyronitrile (0.1 weight percent). The polymer tube and its contents are then subjected to 2 freeze-thaw cycles before sealing under a vacuum. The sealed polymer tube and its contents are placed in a water bath at 60° C and the polymerization allowed to proceed for 17 hours. No noticeable color or viscosity change is apparent at the end of this interval. The contents of the tube are then emptied into methanol for precipitation of the polymeric product. Yield 0.38 grams of orange color polymer, $M\overline{n}$ = 3,520 (as determined by standard vapor pressure osmometry techniques).

EXAMPLE X

A 25 weight percent tetrahydrofuran solution containing equal parts by weight of the oligomer of Example VIII and Flexclad polyester resin (Goodyear Tire & Rubber Co.) is draw bar coated on a thin layer (approximately 0.5 microns) of amorphous selenium which has been previously vacuum coated on a ball-grained aluminum plate. The amount of polymer solids transferred to the selenium plate is sufficient to form a layer having a dry film thickness of approximately 12 microns. Upon substantially complete evaporation of solvent residues from this polymer layer, the electrophotographic properties of the photoconductive composite are evaluated. Such evaluation consist essentially of charging the surface of the polymer coating to a positive potential of about 800 volts followed by imagewise exposure to activating electromagnetic radiation. The latent image formed on the surface of the polymer layer is developed with negatively charged toner particles and the toner image thereafter transferred to a sheet of plain paper. The toner residues remaining on the surface of the polymer coating are removed by wiping with a soft cotton cloth and the reproduction cycle repeated. Copy quality is good and is reproducible.

EXAMPLE XI

A 35 weight percent tetrahydrofuran solution containing 15 weight percent of the oligomer of Example VII, 10 weight percent polyethylene terephthalate resin (Mylar 49000, available from E. I. duPont de Nemours and Company ) and 10 weight percent N-ethylcarbazole is draw bar coated on a flexible conductive substrate (aluminized Mylar film). Sufficient solids are transferred to the conductive substrate to form a polymer layer having a dry film thickness of approximately 20 microns. Due to charge transfer interaction of the electronically active groups pendant from the oligomer and N-ethylcarbazole, the polymeric layer is highly colored. After the polymeric layer is substantially free of solvent residues, it is evaluated electrophotographically by initially charging its surface to a positive potential of about 800 volts followed by imagewise exposure to white light. The latent electrostatic image formed on its surface is thereafter developed with negatively charged toner particles and the toner image subsequently transferred to a sheet of plain paper. The surface of the polymeric coating is wiped with a cotton cloth for removal of toner residues and the reproduction cycle repeated. Copy quality is acceptable and reproducible.

WHAT IS CLAIMED IS:

1. A composite photoconductive insulating film comprising a layer of photoconductive materials having substantial spectral response in the visible region of the electromagnetic spectrum and a substantially colorless insulating layer contiguous therewith comprising a polymeric solid containing a minor portion of electronically inert polymeric binder and a major portion of electronically active oligomer of the formula:

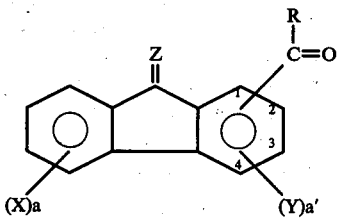

wherein R is

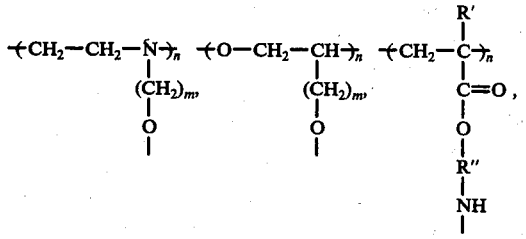

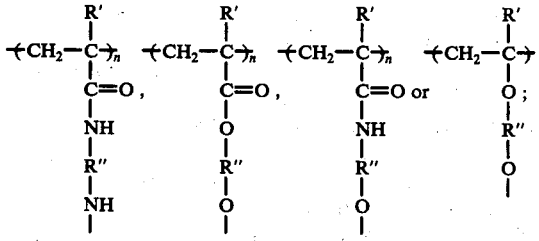

R′ is hydrogen or methyl;
R″ is alkyl of 1–10 carbon atoms;
X and Y are independently selected from the group consisting of $NO_2$, halogen, cyano and $—CF_3$;
Z is oxygen or dicyanomethylene;
*a* and *a′* can range from 0—4;
*m* is 1–10; and
*n* is in the range of from about 3 to about 25.

2. The composite photoconductive insulating film of Claim 1 wherein the thickness of the layer of photoconductive materials in this composite film can range from about 0.02 to about 5 microns and the thickness of the insulating layer from about 1 to about 200 microns, the ratio of thickness of the layer of photoconductive materials to the insulating layer being maintained within from about 1:2 to about 1:200.

3. An electrophotographic imaging member comprising a conductive substrate and a composite photoconductive insulating film overlying at least a portion of said substrate, said composite comprising a layer of photo conductivematerials having substantial spectral response in the visible region of the electromagnetic spectrum and a substantially colorless insulating layer contiguous therewith comprising a polymeric solid containing a minor portion of electronically inert polymeric binder and a major portion of electronically active oligomer of the formula:

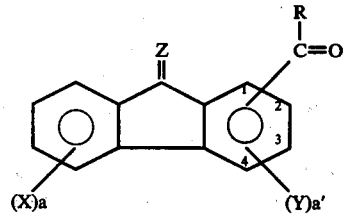

wherein R is

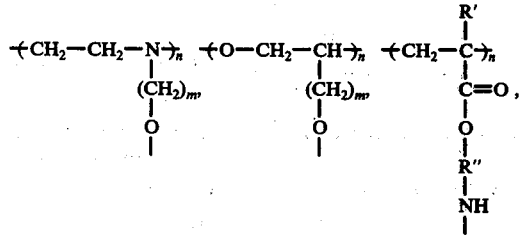

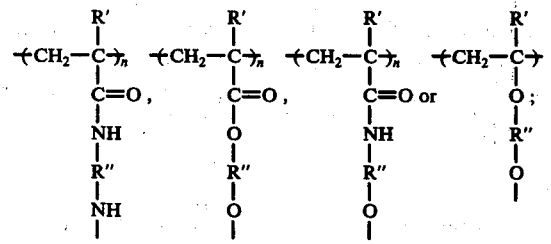

R′ is hydrogen or methyl;
R″ is alkyl of 1–10 carbon atoms;
X and Y are independently selected from the group consisting of $NO_2$, halogen, cyano and $—CF_3$;
Z is oxygen or dicyanomethylene;
*a* and *a′* can range from 0–3;
*m* is 1–10; and
*n* is in the range of from about 3 to about 25.

4. The electrophotographic imaging member of claim 3 wherein the thickness of the layer of photoconductive materials in this composite film can range from about 0.02 to about 5 microns and the thickness of the insulating layer from about 1 to about 200 microns, the ratio of thickness of the layer of photoconductive materials to the insulating layer being maintained within from about 1:2 to about 1:200.

5. An electrostatographic imaging process comprising:

a. providing an electrophotographic imaging member comprising a conductive substrate and a composite photoconductive insulating film overlying at least a portion of said substrate, said composite comprising a layer of photoconductive materials having substantial spectral response in the visible region of the electromagnetic spectrum and a substantially colorless insulating layer continguous therewith comprising a polymeric solid containing a minor portion of electronically inert polymeric binder and a major portion of electronically active oligomer of the formula:

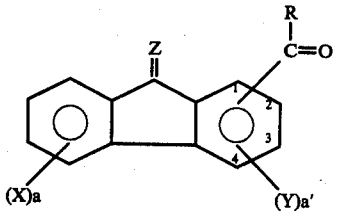

wherein R is

-continued

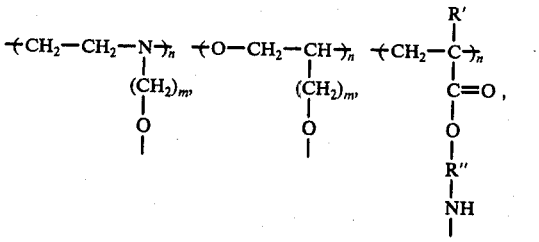

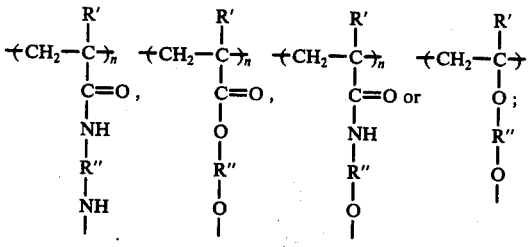

R' is hydrogen or methyl;
R'' is alkyl of 1–10 carbon atoms;
X and Y are independently selected from the group consisting of $NO_2$, halogen, cyano and $—CF_3$;
Z is oxygen or dicyanomethylene;
*a* and *a'* can range from 0–3;
*m* is 1–10; and
*n* is in the range of from about 3 to about 25.

b. forming a latent electrostatic image on said imaging member.

6. The process of claim 5 wherein the thickness of the layer of photoconductive materials in this composite film can range from about 0.02 to about 5 microns and the thickness of the insulating layer from about 1 to about 200 microns, the ratio of thickness of the layer of photoconductive materials to the insulating layer being maintained within from about 1:2 to about 1:200.

* * * * *

UNITED STATES PATENT AND TRADEMARK OFFICE

CERTIFICATE OF CORRECTION

PATENT NO. : 4,063,947

DATED : December 20, 1977

INVENTOR(S) : John M. Pochan and Sam R. Turner

It is certified that error appears in the above-identified patent and that said Letters Patent are hereby corrected as shown below:

Column 11, line 67 (Claim 1), "4" should be --3--.

Column 13, line 18 (Claim 5), "contingous" should be --contiguous--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*